US009395113B2

(12) United States Patent
Dodson

(10) Patent No.: US 9,395,113 B2
(45) Date of Patent: Jul. 19, 2016

(54) NUCLEATOR FOR GENERATING ICE CRYSTALS FOR SEEDING WATER DROPLETS IN SNOW-MAKING SYSTEMS

(71) Applicant: Mitchell Joe Dodson, Park City, UT (US)

(72) Inventor: Mitchell Joe Dodson, Park City, UT (US)

( * ) Notice: Subject to any disclaimer, the term of this patent is extended or adjusted under 35 U.S.C. 154(b) by 0 days.

(21) Appl. No.: 14/217,206

(22) Filed: Mar. 17, 2014

(65) Prior Publication Data

US 2014/0291413 A1 Oct. 2, 2014

Related U.S. Application Data

(60) Provisional application No. 61/786,484, filed on Mar. 15, 2013.

(51) Int. Cl.
*F25C 3/04* (2006.01)

(52) U.S. Cl.
CPC ..... *F25C 3/04* (2013.01)

(58) Field of Classification Search
CPC ..... F25C 3/04; F25C 2303/048; F25C 2303/0481
USPC ..... 239/14.2
See application file for complete search history.

(56) References Cited

U.S. PATENT DOCUMENTS

| | | | | |
|---|---|---|---|---|
| 1,844,187 | A | | 2/1932 | Smith |
| 3,301,485 | A | | 1/1967 | Tropeano et al. |
| 3,383,054 | A | | 5/1968 | Nugarus |
| 3,716,190 | A | | 2/1973 | Lindlof |
| 3,761,020 | A | | 9/1973 | Tropeano et al. |
| 3,776,471 | A | | 12/1973 | Meyer et al. |
| 3,908,903 | A | | 9/1975 | Burns, Jr. |
| 3,969,908 | A | | 7/1976 | Lawless et al. |
| 4,004,732 | A | | 1/1977 | Hanson |
| 4,141,507 | A | | 2/1979 | Rump |
| 4,145,000 | A | | 3/1979 | Smith et al. |
| 4,343,434 | A | | 8/1982 | Haruch |
| 4,349,156 | A | | 9/1982 | Haruch et al. |
| 4,353,504 | A | | 10/1982 | Girardin et al. |
| 4,383,646 | A | | 5/1983 | Smith |
| 4,442,047 | A | | 4/1984 | Johnson |
| 4,465,230 | A | | 8/1984 | Ash |
| 4,493,457 | A | * | 1/1985 | Dilworth et al. ..... 239/2.2 |
| 4,516,722 | A | | 5/1985 | Avery |

(Continued)

FOREIGN PATENT DOCUMENTS

| | | | |
|---|---|---|---|
| CA | 2015646 | C | 7/2002 |
| DE | 2855906 | A1 | 7/1980 |

(Continued)

OTHER PUBLICATIONS

Extended European Search Report for EP Application No. 09816598.8, EP Publication No. 2,326,429, Jan. 31, 2013.

(Continued)

*Primary Examiner* — Christopher Kim
(74) *Attorney, Agent, or Firm* — Paul C. Oestreich; Eminent IP, P.C.

(57) ABSTRACT

The present invention is an improved nucleator for generating ice crystals for seeding water droplets in snow-making systems. Atomized water droplets can more easily be converted to snow at higher temperatures by using a nucleator. Embodiments of a snow-making gun including the novel nucleator are also described.

13 Claims, 7 Drawing Sheets

(56) References Cited

U.S. PATENT DOCUMENTS

| | | | |
|---|---|---|---|
| 4,742,959 | A | 5/1988 | Stanchak et al. |
| 4,793,554 | A | 12/1988 | Kraus et al. |
| 4,903,895 | A | 2/1990 | Mathewson et al. |
| 4,915,302 | A | 4/1990 | Kraus et al. |
| 4,993,635 | A | 2/1991 | Dupre |
| 5,004,151 | A | 4/1991 | Dupre |
| 5,064,118 | A | 11/1991 | Lauricella |
| 5,090,619 | A | 2/1992 | Barthold et al. |
| 5,135,167 | A | 8/1992 | Ringer |
| 5,154,348 | A | 10/1992 | Ratnik et al. |
| 5,400,966 | A | 3/1995 | Weaver et al. |
| 5,520,331 | A | 5/1996 | Wolfe |
| 5,529,242 | A | 6/1996 | Hedin |
| 5,593,090 | A | 1/1997 | Werner |
| 5,692,682 | A | 12/1997 | Soule |
| 5,699,961 | A | 12/1997 | Ratnik et al. |
| 5,810,251 | A | 9/1998 | McKinney |
| 5,823,436 | A | 10/1998 | Waldrum |
| 5,909,844 | A | 6/1999 | Nilsson |
| 5,934,556 | A | 8/1999 | Charriau et al. |
| 6,007,676 | A | 12/1999 | Bartels et al. |
| 6,032,872 | A | 3/2000 | Dupre |
| 6,119,956 | A | 9/2000 | McKinney |
| 6,129,290 | A | 10/2000 | Nikkanen |
| 6,152,380 | A | 11/2000 | Dupre |
| 6,161,769 | A | 12/2000 | Kircher et al. |
| 6,182,905 | B1 | 2/2001 | Dupre |
| 6,402,047 | B1 | 6/2002 | Thomas |
| 6,508,412 | B1 | 1/2003 | Pergay et al. |
| 6,547,157 | B2 | 4/2003 | Jervas |
| 6,719,209 | B1 | 4/2004 | Pergay et al. |
| 6,793,148 | B2 | 9/2004 | Ratnik |
| 7,114,662 | B1 | 10/2006 | Nikkanen |
| 7,124,964 | B2 | 10/2006 | Bui |
| 7,546,960 | B2 | 6/2009 | Stofner |
| 7,770,816 | B2 | 8/2010 | Rieder |
| 8,393,553 | B2 | 3/2013 | Sankrithi et al. |
| 8,534,577 | B2 | 9/2013 | Dodson |
| D692,528 | S | 10/2013 | Dodson |
| D692,982 | S | 11/2013 | Dodson |
| D693,902 | S | 11/2013 | Dodson |
| 2004/0046041 | A1 | 3/2004 | Dupre |
| 2004/0112976 | A1 | 6/2004 | Galvin et al. |
| 2006/0049273 | A1 | 3/2006 | Zhang |
| 2006/0071091 | A1 | 4/2006 | Ratnik |
| 2006/0113400 | A1 | 6/2006 | Dodson |
| 2011/0049258 | A1 | 3/2011 | Lehner et al. |
| 2011/0168808 | A1 | 7/2011 | Mitch |

FOREIGN PATENT DOCUMENTS

| | | | |
|---|---|---|---|
| DE | 19819982 | A1 | 9/1999 |
| DE | 19838785 | A1 | 3/2000 |
| DE | 10215580 | A1 | 10/2003 |
| DE | 102004053984 | B3 | 6/2006 |
| EP | 0787959 | A1 | 8/1997 |
| EP | 00824658 | B1 | 2/1998 |
| EP | 00835162 | B1 | 4/1998 |
| EP | 1283400 | A2 | 2/2003 |
| EP | 1473528 | A1 | 11/2004 |
| FR | 2594528 | A1 | 8/1987 |
| FR | 2617273 | A1 | 12/1988 |
| FR | 2877076 | A1 | 4/2006 |
| GB | 2214108 | A | 8/1989 |
| JP | 2005127577 | A | 5/2005 |
| WO | WO90/12264 | A1 | 10/1990 |
| WO | WO94/19655 | A1 | 9/1994 |
| WO | WO97/01392 | A1 | 1/1997 |
| WO | WO03/054460 | A1 | 7/2003 |
| WO | WO03/084668 | A2 | 10/2003 |
| WO | WO2004/087329 | A1 | 10/2004 |
| WO | WO2009/043092 | A1 | 4/2009 |
| WO | WO2010/036372 | A1 | 4/2010 |

OTHER PUBLICATIONS

PCT International Search Report for International Patent Application No. PCT/US2014/030878, Oct. 3, 2014.

* cited by examiner 320
6D
6D

320

602
606
600
320

604
45.0°
328
604
320

320

45.0°
6E
320
40.0°
6E

NUCLEATOR FOR GENERATING ICE CRYSTALS FOR SEEDING WATER DROPLETS IN SNOW-MAKING SYSTEMS

CROSS-REFERENCE TO RELATED APPLICATIONS

This non-provisional patent application claims benefit and priority to the filing of U.S. Provisional Patent Application No. 61/786,484 filed on Mar. 15, 2013, titled "NUCLEATOR FOR GENERATING ICE CRYSTALS FOR SEEDING WATER DROPLETS IN SNOW-MAKING SYSTEMS", the contents of which are incorporated by reference as if fully set forth herein.

BACKGROUND OF THE INVENTION

1. Field of the Invention

The present invention relates generally to snow-making equipment. More particularly, this invention relates to a nucleator for generating ice crystals for seeding water droplets in snow-making systems.

2. Description of Related Art

The production of artificial snow is well-known in the art. Currently there are generally four different methods of snow-making: (1) fan guns, (2) internal mix air and water guns, (3) external mix air water guns and (4) water only guns.

Fan guns consist of a large barrel with an enclosed electric fan that forces large volumes of ambient air through the barrel. On the end of the barrel there is a configuration of water nozzles usually arranged in banks that can be turned on independently of each other. Each bank can consist of up to 90 small capacity hollow cone nozzles which produce very fine particles. The water particles are projected into the ambient air by the large volume of air that the fan produces. Fan guns may include an outer ring that is called the nucleating ring. This ring has a small number of miniature air/water nozzles that operate in the same way as an internal mix air/water gun. An onboard compressor is used to operate this ring. The nucleating ring's primary role is to produce ice crystals. The ice crystals are carried along the outside of the bulk water plume for a distance before becoming ingested into the plume thus nucleating the bulk water plume. Operation of the fan gun is achieved by opening one bank of nozzles at a time and altering the water pressure to the nozzles. Once full pressure is achieved on a bank another bank is opened and the water pressure is adjusted.

Internal mix air and water guns consist of a compressed air line and a water line converging into a common chamber with an exit orifice. Compressed air enters the common chamber and expands breaking up the water stream into smaller particles and projecting them into the ambient air. Operation of the gun is achieved by regulating the water pressure entering the common chamber. A common feature of the internal mix gun is that when water flow is increased air flow is decreased and vice versa. Water pressure cannot usually exceed the air pressure which is usually 80-125 psi. There are a multitude of orifice and mixing chamber shapes that produce a wide variety of plumes and droplet sizes.

External mix air and water guns usually consist of a configuration of fixed orifice flat jet nozzles arranged on a head that spray water into the ambient air. The head is usually put on a mast in order to give the water droplets more hang time due to the fact there is no compressed air to break the water droplets into smaller particles or to propel them. As with the fan guns the external mix guns may include nucleating nozzles that use small internal mix nozzles to produce ice crystals which are directed into the bulk water plume. Control of the gun may be achieved by changing the fixed orifice flat jet nozzles for a different size or opening banks of nozzles as with the fan gun.

Water only snow guns have no compressed air or nucleating nozzles. The head of a water only snow gun comprises a number of flat jet nozzles assembled on a high mast, usually a minimum of 6 m in height. Snow guns of this type can only be used at temperatures starting at −6° C. and work better with a high temperature nucleation additive.

These various types of snow guns or snow lances are employed with particular application in winter sports recreation areas. Generally, the most effective way to generate artificial snow is to nucleate water droplets projected into cold air. The stream of tiny water droplets is thus mixed in the atmosphere with a stream of nucleating agents, typically tiny ice crystals. The two different streams of water particles are configured to intersect in a region referred to as a germination region where snow may be formed by the combination of the two different streams of water particles. The ice-seeded water droplets form snowflakes as they continue to freeze along their gravity dependent trajectories in the air and eventually fall to the ground to form snow. This artificial snow is particularly useful for supplementing natural snowfall at ski and snowboard resorts.

This application is primarily concerned with the nucleating agents and the mechanisms and techniques for generating them and combining them with streams of water particles. Such nucleating agents may consist of tiny ice particles or nuclei which may be formed using a "nucleator". A nucleator generally forms the stream of tiny ice particles using compressed air and cold water in a mixing chamber before expelling the tiny ice particles out of an exit orifice or nozzle. U.S. Patent Application Publication No. 2011/0049258 A1 to Lehner et al., incorporated herein by reference for all purposes as if fully set forth in this specification, discloses a conventional nucleator nozzle having an axial compressed air inlet opening at one end that directs compressed air into an axial nozzle channel. This conventional nucleator nozzle also includes a lateral water inlet opening which feeds water into the nozzle channel at an angle perpendicular to the nozzle channel axis. The compressed air and water combine in a mixing chamber portion of the axial nozzle channel. The combined water and air mixture is then directed toward an exit orifice or nozzle.

The exit orifice or nozzle of Lehner et al. is a conventional convergent-divergent nozzle configuration. That is to say that the nozzle channel tapers in diameter in a first section down to a core, or narrowest, diameter. In a second expanding region, the nozzle channel expands from the core diameter to an outlet opening with greater diameter than the core diameter. The expanding region of a convergent-divergent nozzle typically generates a negative pressure which, when combined with the compressed air and water mixture, generates tiny ice particles when ejected into cold air.

While conventional nucleators, including those disclosed in Lehner et al. generate nucleating particles useful for snow-making, improvements to nucleators are needed to increase the efficiency and reduce the cost of operation while offering a more robust snow-making gun that operates in a wide range of ambient conditions. Accordingly, there exists a need in the art for an improved nucleator for generating ice crystals for seeding water droplets in snow-making systems.

BRIEF SUMMARY OF THE INVENTION

The present invention is an improved nucleator for generating ice crystals for seeding water droplets in snow-making systems. Atomized water droplets can more easily be converted to snow by using a nucleator. Embodiments of a snow-making gun including the novel nucleator are also described.

An embodiment of a nucleator for generating ice crystals for seeding water droplets used in a snow-making system is disclosed. The embodiment of a nucleator may include a mixing chamber including a compressed air inlet for receiving compressed air directed along a mixing chamber axis. The embodiment of a mixing chamber may further include a water inlet for receiving water toward the mixing chamber axis and an exit orifice for delivering a mixture of compressed air and water. The embodiment of a nucleator may further include a nucleator block for receiving the mixture and configured for dividing and directing the mixture into a plurality of nozzle channels. According to this embodiment, each nozzle channel may lie in a plane perpendicular to, and separated from, one another by a select number of degrees. The embodiment of a nucleator may further include a plurality of nucleator nozzles, each of the plurality of nucleator nozzles configured with a nozzle inlet and a nozzle outlet, each of the plurality of nucleator nozzles further configured for receiving one of the plurality of nozzle channels at the nozzle inlet and continuously pressurizing the mixture along a convergent portion of the nozzle, thereby creating a pressurized mixture until the pressurized mixture reaches a core diameter of the nozzle, the pressurized mixture passing through the core diameter and directed through a divergent portion of the nozzle channel where the pressurized mixture depressurizes until exiting the nozzle outlet as tiny ice crystals.

Additional features and advantages of the invention will be apparent from the detailed description which follows, taken in conjunction with the accompanying drawings, which together illustrate, by way of example, features of embodiments of the present invention.

BRIEF DESCRIPTION OF THE SEVERAL VIEWS OF THE DRAWINGS

The following drawings illustrate exemplary embodiments for carrying out the invention. Like reference numerals refer to like parts in different views or embodiments of the present invention in the drawings.

DETAILED DESCRIPTION OF THE INVENTION

Figure 1:
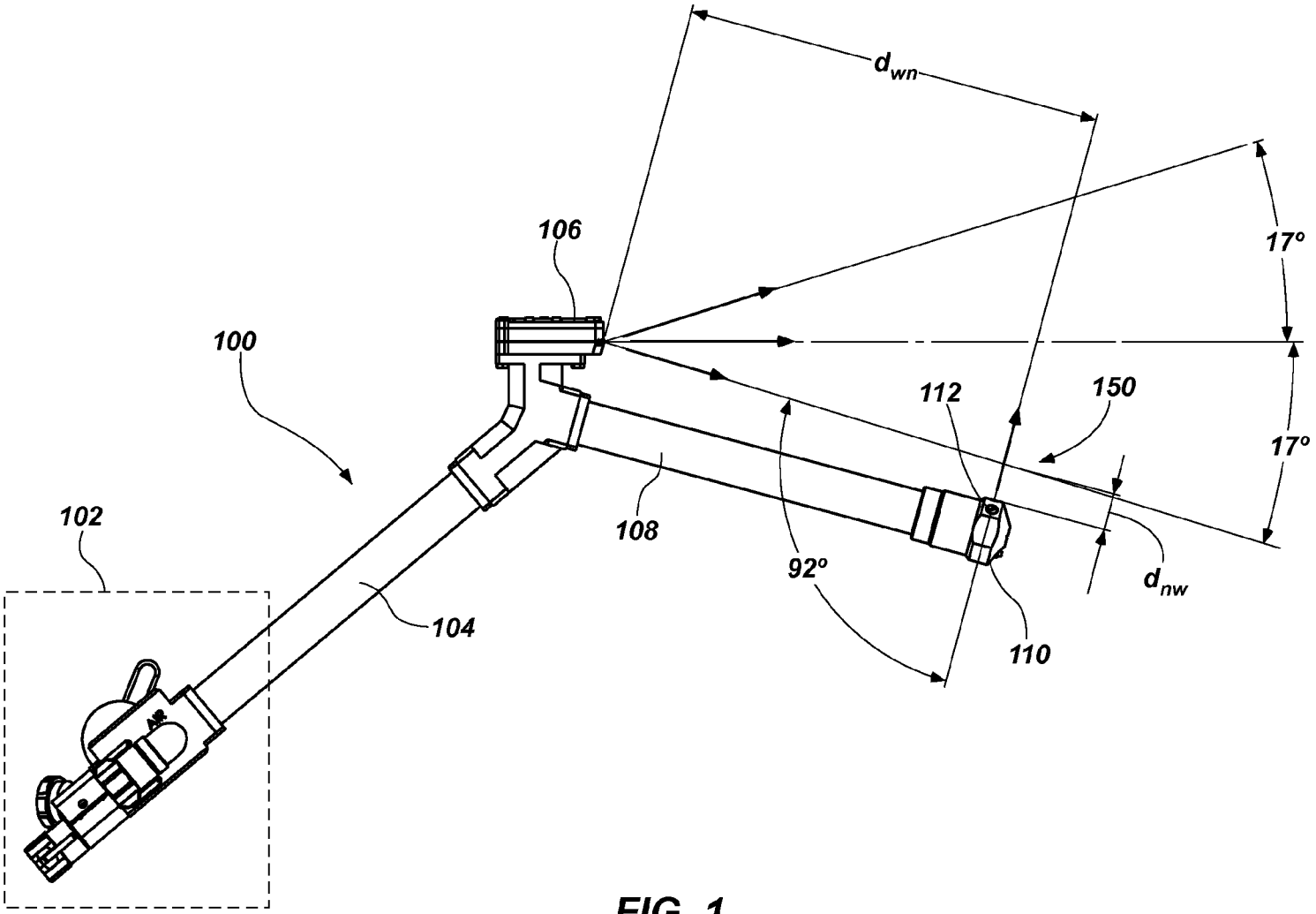
FIG. 1 is a side view of an embodiment of a snow-making gun incorporating an embodiment of a nucleator according to the present invention.

The present invention is an improved nucleator for generating ice crystals for seeding water droplets in snow-making systems. Atomized water droplets can more easily be converted to snow by using a nucleator. Embodiments of a snow-making gun including the novel nucleator are also described.

The snowmaking process involves spraying water droplets into cold ambient air. Heat from the water droplets is transferred into the ambient air and the water droplets begin to freeze. If there is a sufficient temperature differential between the water droplets along with sufficient hang time in the air, the water droplet will freeze before hitting the ground. The volume of water that can be converted into snow depends on many factors. In order to explain the operation of the snow-making equipment described herein and, in particular, the complexities and important characteristics that result in an improved snow-making technique, it is first necessary to consider, in general terms, the science of snowmaking.

Snow-making is a heat exchange process. Heat is removed from snowmaking water by evaporative and convective cooling and then released into the surrounding environment. This heat creates a micro-climate inside the snowmaking plume that is distinct relative to ambient conditions. There are many variables that affect snowmaking. Three of the most important variables are wet bulb temperature, nucleation temperature and droplet size. Wet bulb temperature, the temperature of a water droplet exiting a snow gun is typically between +1° C. and +6.5° C. Once a water droplet exits a nozzle and is released into the air, its temperature falls rapidly due to expansive and convective cooling and evaporative effects. The droplet's temperature will continue to fall until equilibrium is reached. This equilibrium temperature is the wet bulb temperature. The wet bulb temperature is as important as dry bulb (ambient) temperature in predicting snow-making success. For example, snow-making temperatures at −2° C. and 10% humidity are equivalent to those at −7° C. and 90% humidity.

Once the wet bulb temperature is known, there must be a way to predict whether water droplets will actually freeze at that temperature. Ice is the result of a liquid (water) becoming a solid (ice) by an event called nucleation. In order to freeze, a water droplet must first reach its nucleation temperature. There are two types of nucleation, homogeneous nucleation and heterogeneous nucleation.

Homogeneous nucleation occurs in pure water in which there is no contact with any other foreign substance or surface. With homogeneous nucleation, the conversion of the liquid state to solid state is done by either lowering temperatures or by changes in pressure. However, temperature is the primary influence on the conversion of water to ice or ice to water. In homogeneous nucleation, the nucleation begins when a very small volume of water molecules reaches the solid state. This small volume of molecules is called the embryo and becomes the basis for further growth until all of the water is converted. The growth process is controlled by the rate of removal of the latent heat being released. Molecules are attaching and detaching from the embryo at roughly equal and very rapid rates. As more molecules attach to the embryo, energy is released causing the temperature of the attached molecules to be lower than the temperature of the unattached molecules. The growth rate continues until all the molecules are attached. At this point, the solid state (ice) is established. Many people think that pure water freezes at 0° C. or 32° F. Intact, the nucleation event (freezing) for pure water can take place at temperatures as low as minus 40° C. or minus 40° F. However, this is most likely to occur in laboratory experiments or high in the upper atmosphere (upper troposphere).

Heterogeneous nucleation occurs when ice forms at temperatures above minus 40° C. or minus 40° F. due to the presence of a foreign material in the water. This foreign material acts as the embryo and grows more rapidly than embryos of pure water. The location at which an ice embryo is formed is called the ice-nucleating site. As with homogeneous nucleation, heterogeneous nucleation is governed by two major factors: the free energy change involved in forming the embryo and the dynamics of fluctuating embryo growth. In heterogeneous nucleation, the configuration of molecules and energy of interaction at the nucleating site become the dominating influence in the conversion of water to ice. Snowmaking involves the process of heterogeneous nucleation. There are many materials and substances which act as nucleators. Each one of these materials and substances promotes freezing at a specific temperature or nucleation temperature. These nucleators are generally categorized as a high-temperature (i.e., silver iodide, dry ice, ice and nucleating proteins) or low-temperature (i.e., calcium, magnesium, dust and silt) nucleators. It is low-temperature nucleators that are found in large numbers in untreated snowmaking water. The nucleation temperature of snowmaking water is between −10° C. and −7° C.

Research has demonstrated that 95% of natural, untreated water droplets will freeze at widely different temperatures, the average temperature being 18.2° F. Introducing a consistent high temperature nucleator into the water will raise the freezing point. As a water droplet cools, heat energy is released into the atmosphere at a rate of one calorie per gram of water. As it freezes into an ice crystal, the water droplet will release additional energy at a rate of 80 calories per gram of water. This quick release of energy raises the water droplet temperature to 32° F., where it will remain while freezing continues. This is one reason why we are accustomed to thinking that water freezes at 32° F. or 0° C. The water will continue to freeze as long as it remains at or below 32° F. or 0° C., but only after it has first cooled to its nucleation temperature. Any excess energy will be dissipated into the atmosphere.

Since the distribution of various nucleators in a given volume of water is totally random, the size of the water droplet or the number of high-temperature nucleators has a significant effect on the temperature at which freezing occurs (nucleation temperature). In natural water, as the size of the water droplet decreases, the likelihood that the droplet will contain a high-temperature nucleator also decreases. Conversely, larger water droplets stand a better chance of containing high-temperature nucleators. The optimum situation for snowmakers is one in which every droplet of water passing through the snow gun nozzle contains at least one high-temperature nucleator and freezes in the plume.

The relationship between the variables of nucleation temperature and droplet size is summarized in two statistically valid conclusions. First, a 50% increase in the droplet size results in a one-degree, F., increase in nucleation temperature. Second, a 50% decrease in droplet size results in a three-degree, F., decrease in nucleation temperature. These conclusions are based on an average droplet size of 300 microns, and indicate that decreasing the droplet size can be counter-productive to promoting high-temperature nucleation, unless enough high-temperature nucleators are present. Looking at the relationship between droplet size and evaporation, research in cloud seeding shows that: (1) a 50% decrease in droplet size produces, a four-fold increase in the evaporation rate, and (2) a droplet that is 50% smaller will evaporate to nothing after falling just one-eighth the distance that the average 300 micron droplet falls. These conclusions further point out the undesirable results from using very small droplets, especially in areas where water loss is a critical issue. Relating droplet size to nucleation temperature, it is possible to increase snowmaking production and efficiency by using high-temperature nucleators with larger water droplets. This method frequently allows for increased water flow, reduces evaporation, and yields more snow on the ground. In fact, studies indicate that a 20% increase in water flow can increase snow volume up to 40% if droplet size and nucleation temperature are optimized. See, e.g., U.S. Patent Publication No. US 2006/0113400 A1 to Dodson.

The size of the water droplet determines its ability to convert to snow. There are many methods to convert a water stream into water droplets of varying sizes. Use of water nozzles and compressed air are two of the predominant methods. Small water droplets offer more surface area per water molecule to the ambient air but are prone to evaporation in low humidity and are less likely to have high temperature nucleators present. Being smaller they have less mass and are vulnerable to high winds which can carry them away. Smaller particles also have a lower velocity and a greater hang time. Small water droplets are desirable at marginal snowmaking temperatures due to the larger surface area and a greater hang time which aids when there is a low temperature differential with the ambient air. The larger surface area also assists the evaporative cooling effect.

Larger water droplets have less surface area per water molecule, greater mass, higher velocity and have a higher chance of having high temperature nucleators present. When the ambient air is colder the temperature differential is greater with the particle temperature therefore a greater heat exchange occurs. The latent heat that is given off by the water particles is easily dissipated into the surrounding ambient air. The higher the velocity, the greater the heat exchange. From this analysis of droplet size, one can conclude that an optimized snow making gun should produce a small droplet size in marginal conditions and a larger particle in colder conditions.

Another factor to consider in the snow-making process is hang time. The longer the water droplet is in contact with the ambient air, the higher probability the particle has to freeze. Thus, a snow-making gun has greater production when it is higher in the air. Droplets projected at a higher velocity will also achieve a greater hang time. Thus, it is preferable to configure a snow-making gun as high as possible over the ground surface and to project the water droplets and ice nucleator particles as fast as possible.

Yet another factor to consider in the snow-making process is water volume. Given the above factors, there is only a certain volume of water that can be converted into snow depending on the efficiencies of the above factors. Control of the water volume should be incorporated into any snow-making gun design to compensate for the change in ambient temperatures.

Most snow-making guns have a system that produces high temperature nucleators, mostly in the form of tiny ice crystals. The formation of these tiny ice crystals is usually achieved by combining pressurized water and compressed air. Air is a mix of gases, largely oxygen and nitrogen. Unlike liquids, gases are compressible. A given volume of air can be contained in a much smaller space by compression. In order to fill that smaller space, however, the gas will exist at a higher pressure. A basic law of physics indicates that the pressure of a gas and its volume are related to its temperature. When pressure goes up, so does the temperature. But, the temperature need not remain high. It can be decreased. When a compressed gas is released and goes back to its original pressure, a significant amount of mechanical energy is released. At the same time, a significant amount of heat is absorbed. It is these last two characteristics that make compressed air such important factor in snowmaking. The mechanical energy released by the air disrupts the stream of water into tiny droplets of water, and then propels them into the atmosphere. As compressed air escapes the gun, it absorbs heat—in other words, it cools.

Various features and embodiments of a novel nucleator will now be described with reference to the drawing figures. FIG. 1 is a side view of an embodiment of a snow-making gun 100 incorporating an embodiment of a nucleator 150 according to the present invention. The gun 100 may include valving, connectors and controls, shown in dashed box 102, for receiving sources of pressurized water and compressed air (not shown). The pressurized water and compressed air may be delivered to a water nozzle head 106 through a snow gun barrel or mast 104. The pressurized water and compressed air may further be delivered to a nucleator, shown generally at arrow 150, through a nucleator barrel 108. The nucleator 150 may include a nucleator head 110 with one or more nucleator nozzles 112 that eject nucleating particles, generally tiny ice crystals vertically upward, shown schematically at upward arrow above nucleating head 110

The pressurized water delivered to water nozzle head 106 may be atomized and ejected at high velocity in any assortment of pressurized stream configurations, for example a dual-vectored stream that has high concentrations of atomized water droplets grouped both horizontally and vertically. Conical and flat jet stream configurations are also consistent with the teachings of the present invention. This dual-vectored stream of atomized water droplets is shown schematically in FIG. 1 as three arrows exiting the water nozzle head 106 in a plume that has a vertically-oriented disbursement angle of about 34°. There is also a strong horizontal component that is difficult to visualize as it would pass into and out of the surface of the drawing, in this side view. This atomized water plume has a trajectory that travels over the top of the nucleator head 110 and intersects its largely vertically-oriented stream of nucleation particles, i.e., tiny ice crystals in what is referred to as a germination zone. In the germination zone, the water droplets from the water nozzle head 106 are seeded with the tiny ice crystals from the nucleator 150 and begin to freeze the water droplets as they continue their gravitational and wind-driven trajectories to fall to the ground as snow.

While may geometric variations of combining water droplet streams with ice crystal streams are suitable for generating artificial snow, the particular configuration illustrated works exceptionally well, because of the following design methodology. The optimal insertion point was located to deliver ice crystals from the nucleator where the temperature of dual-vector water plume is close to 32° F. (0° C.). Thus, the length of the nucleator barrel 108 was optimized. Additionally, it was also a design objective to position the nucleator nozzles at a specific distance from dual-vector water plume where the ice crystals will not be blown away from plume with strong cross winds.

In the embodiment of gun 100 shown in FIG. 1, the linear distance, $d_{wn}$, from the water nozzle head to the plane intersecting the axes of nucleator nozzles 112 in the nucleator head 100 is about 660 mm. The lower end of a dual-vectored water plume will pass a distance, $d_{nw}$, of approximately 55 mm away from the nucleator head 110.

The subassemblies and inner workings of the nucleator 150 will now be described with particular attention to the novel and nonobvious aspects of the embodiments of the various components of the nucleator 150. It will be understood that though a single embodiment is illustrated and described, there are many variations that may be employed within the spirit and scope of the present invention.

Figure 2:
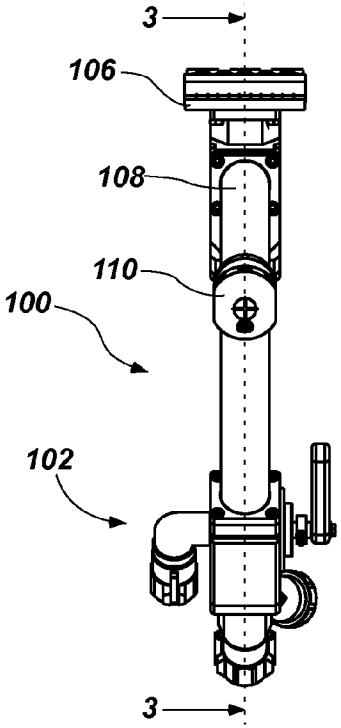
FIG. 2 is a front view of the embodiment of the snow-making gun shown in FIG. 1 indicating the cross-sectional view of FIG. 3, according to the present invention.

FIG. 2 is a front view of the embodiment of the snow-making gun 100 shown in FIG. 1. FIG. 2 indicates the location of the cross-sectional view of FIG. 3, according to the present invention. FIG. 2 further illustrates the water nozzle head 106, nucleator barrel 108, nucleator head 110, and water and air input and control 102.

Figure 3:
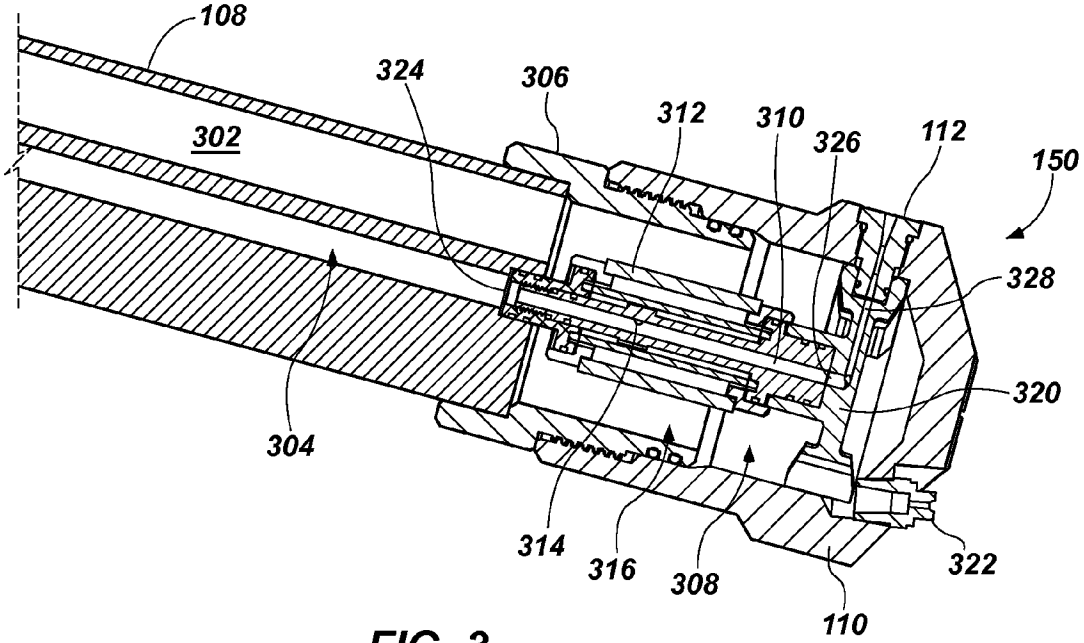
FIG. 3 is a partial cross-section view of the embodiment of a nucleator shown in FIGS. 1-2, according to the present invention.

FIG. 3 is a partial cross-section view of the embodiment of a nucleator 150 shown in FIGS. 1-2, according to the present invention. As shown in FIG. 3, the nucleator barrel 108 delivers pressurized water 302 and compressed air 304 to nucleator 150. The nucleator 150 may include a nucleator barrel cap 306 configured for a threaded engagement with nucleator head 110. Within the nucleator barrel cap 306 covered by the nucleator head 110 is a nucleator assembly 308 housing a mixing chamber 310, water filter 312, water inlet 314, water chamber 316, nucleator block 320, at least one nucleator nozzle 112 and an a flat jet nozzle 322 used to drain the nucleator head 110.

In operation, compressed air 304 enters the mixing chamber 310 at a proximate end 324 of the mixing chamber assembly 308. Pressurized water 302 is filtered at water filter 312 before entering the mixing chamber 310 through water inlet 314. The pressurized water 304 and compressed air 304 generate a mixture of water and air that is directed at a distal end 326 to the nucleator block 320. The nucleator block 320 redirects the mixture of water and air into nozzle channels 328, which in turn, feed into the nucleator nozzles 112. Another feature of the nucleator assembly described herein is the ease of access to all parts in order to facilitate changing filters 312 and cleaning blockages, and any other servicing or adjustment that may be required.

Figure 4A:
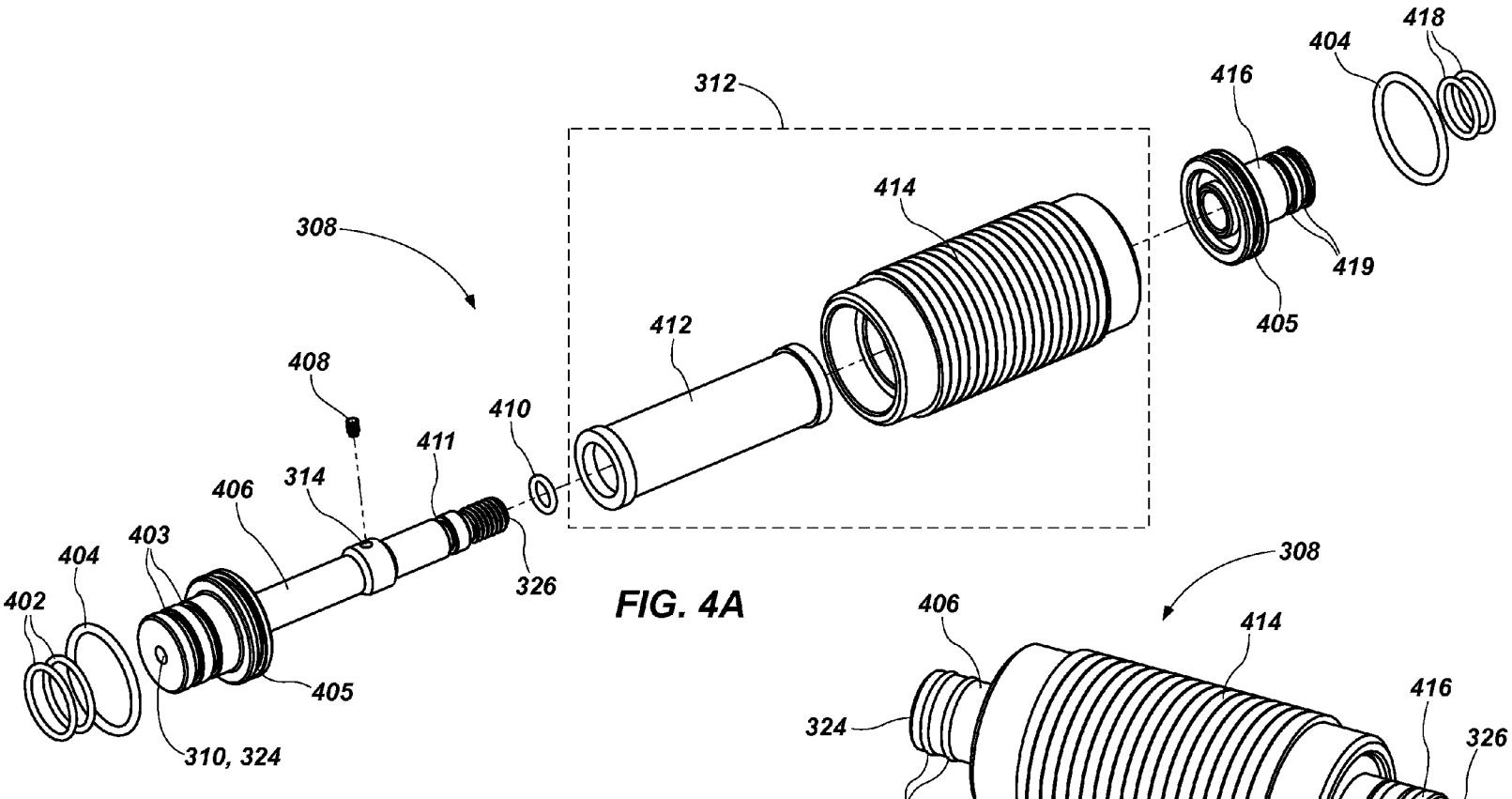
FIGS. 4A and 4B are an exploded view and an assembled view of an embodiment of a mixing chamber assembly according to the present invention.
Figure 4B:
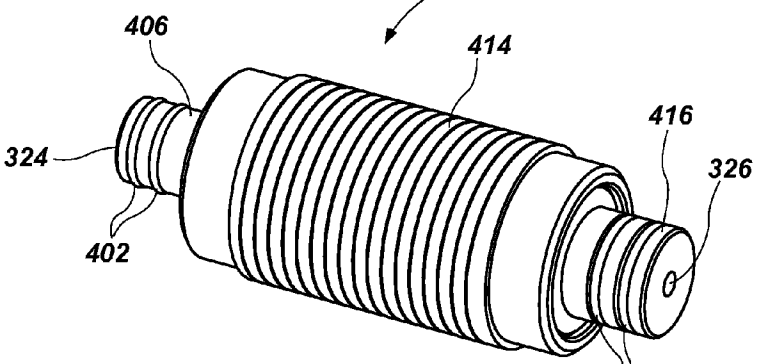

Referring now to FIGS. 4A and 4B, the mixing chamber assembly 308 is shown in greater detail. FIGS. 4A and 4B are an exploded view and an assembled view, respectively, of an embodiment of a mixing chamber assembly 308 according to the present invention. The mixing chamber assembly 308 may include two O-rings 402 of suitable dimensions, e.g., 15 mm inside diameter (ID) and 1.5 mm wide, for mating with corresponding seats 403 on the mixing chamber housing 406. The mixing chamber assembly 308 may further include, and one O-ring 404 of suitable dimensions, e.g., 22 mm ID and 2 mm wide, for mating with seat 405 on the mixing chamber housing 406. The mixing chamber 406 may include water inlet 314 with an orifice lining 408. The mixing chamber 406 may further include seat 411 for receiving O-ring 410 with suitable dimensions, e.g., 6 mm ID, 1.5 mm wide, as shown in FIG. 4A. Water inlet 314 is covered by water filter 312, which in turn comprises mesh particle filter 412 surrounded in turn by wedge wire filter assembly 414. The mixing chamber assembly 308 may further include mixing chamber end cap 416 which is configured for threaded engagement with one end of the mixing chamber housing 406. Finally, another O-ring 404 and two additional O-rings 418 with suitable dimensions, e.g., 11.5 mm ID, 1.5 mm wide, are configured to mate with seats 405 and 419, respectively, formed in the mixing chamber end cap 416.

In operation, compressed air enters the mixing chamber 310 at proximate end 324 of mixing chamber housing 406 and pressurized water enters the water inlet 314 and mixes within the mixing chamber 310. The mixture of pressurized water and compressed air exits out of the distal end 326 of the mixing chamber 310, see, e.g., FIG. 4B.

Figure 5B:
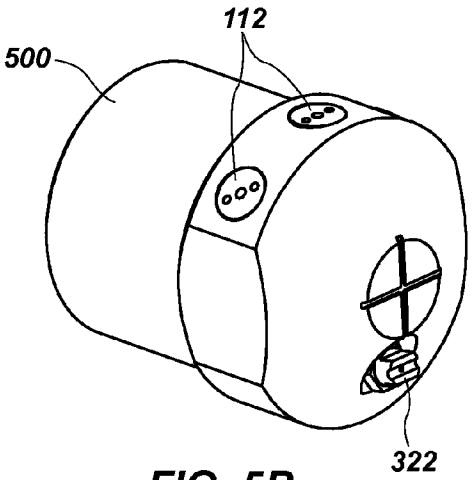
FIGS. 5A-5C are exploded, right front perspective and right rear perspective views, respectively of the nucleator head assembly, according to the present invention.
Figure 5C:
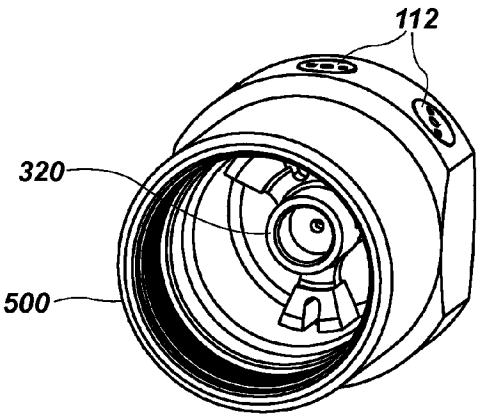
Figure 5A:
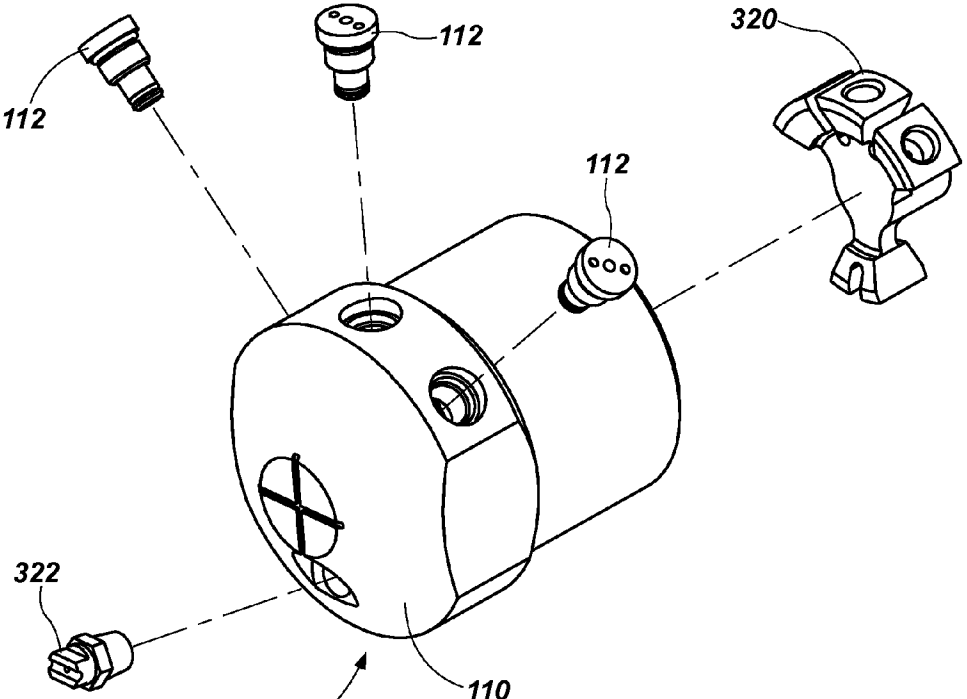

FIGS. 5A-5C are exploded, right front perspective and right rear perspective views, respectively of the nucleator head assembly 500, according to the present invention. More particularly, FIG. 5A illustrates nucleator head 110 which has fittings for receiving three nucleator nozzles 112, a flat jet nozzle 322 used as a drain and a nucleator block 320.

Figures 6A, 6B, 6C, 6D, 6E, 6F:
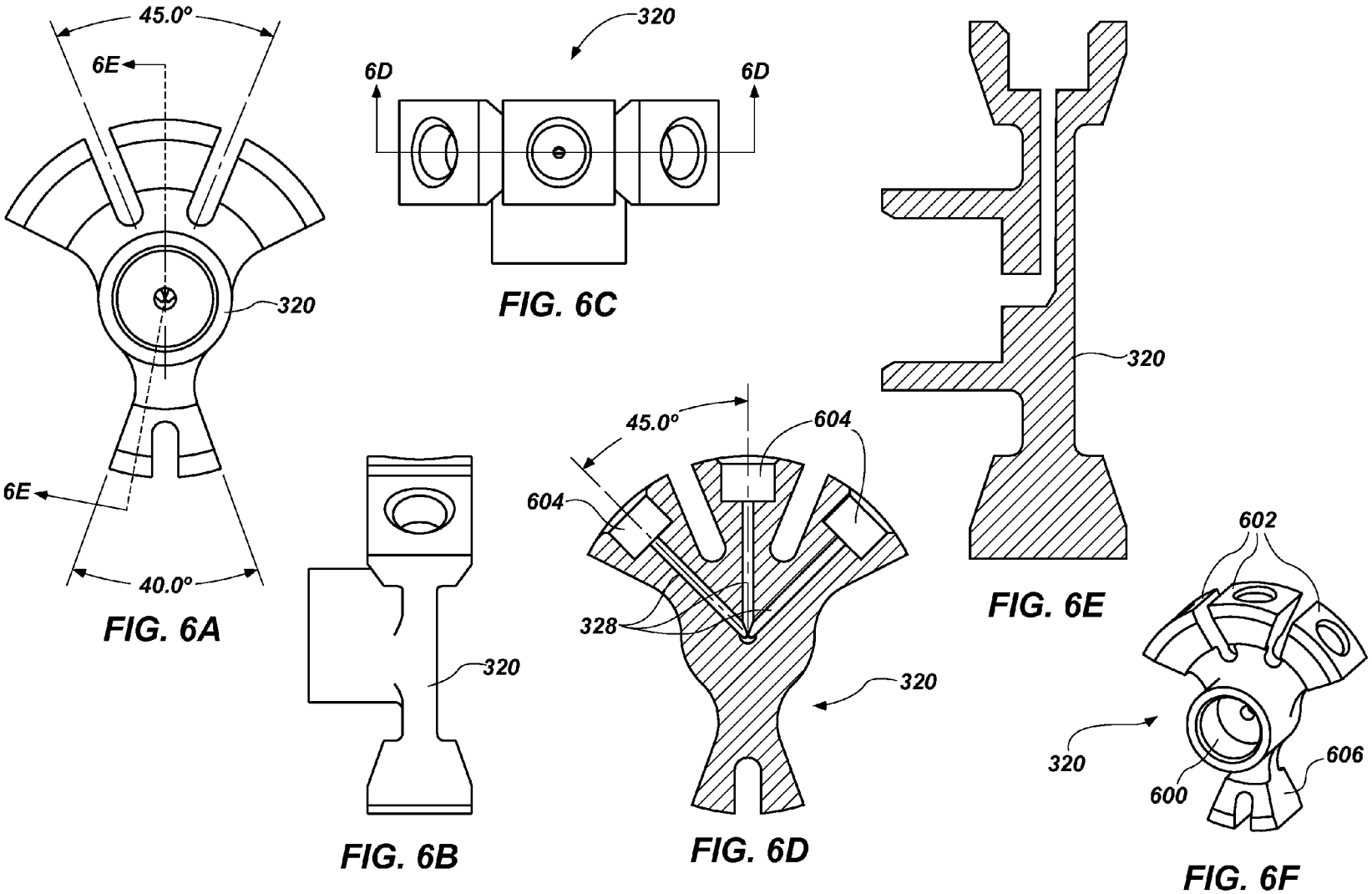
FIGS. 6A-6F are various views and sections of an embodiment of a nucleator block, according to the present invention.
Figure 7D:
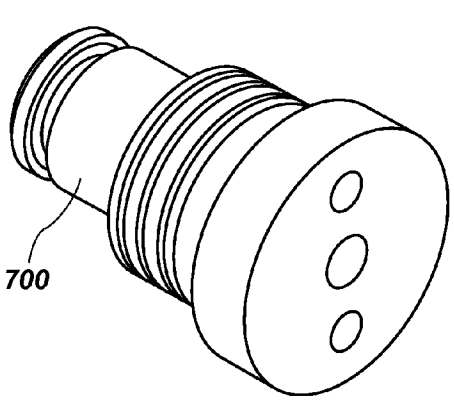
FIGS. 7A-7D are section, side, front and perspective views, respectively of an embodiment of a nucleator nozzle, according to the present invention.
Figure 7C:
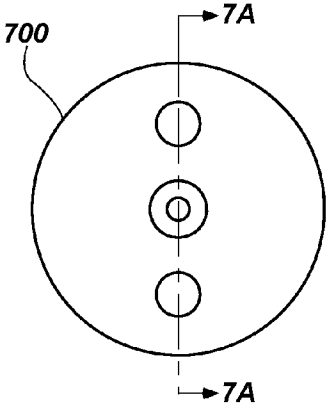
Figure 7B:
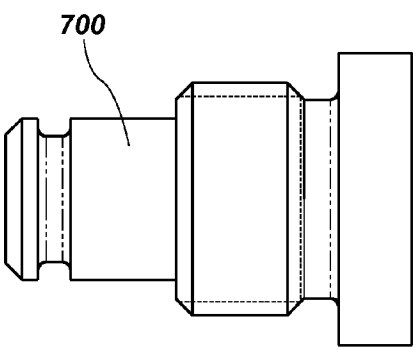
Figure 7A:
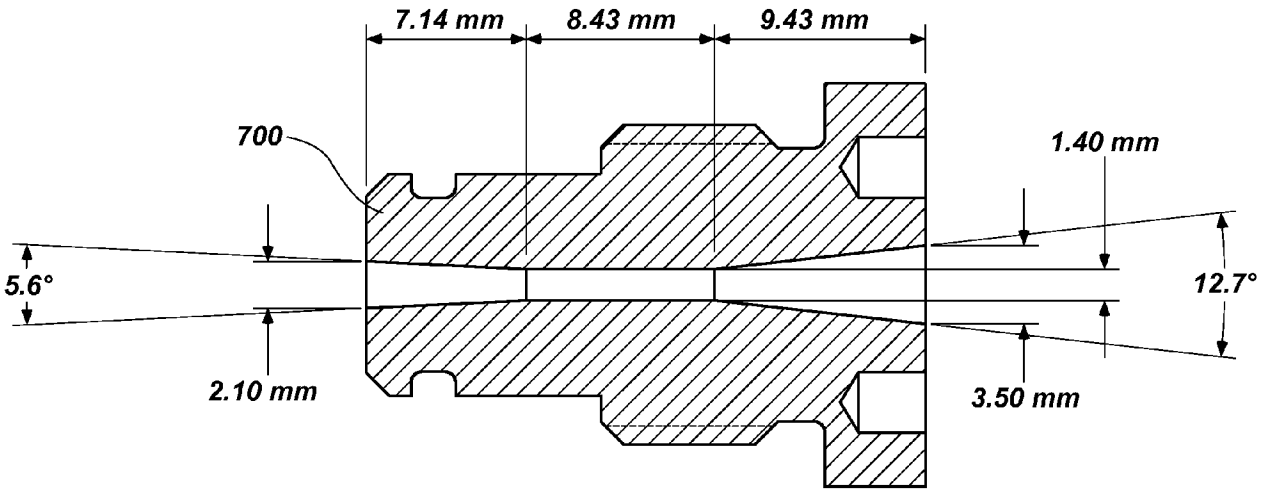
Figure 8D:
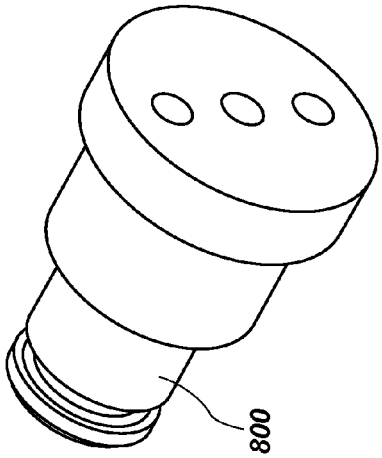
FIGS. 8A-8D are section, side, front and perspective views, respectively of another embodiment of a nucleator nozzle, according to the present invention.
Figure 8C:
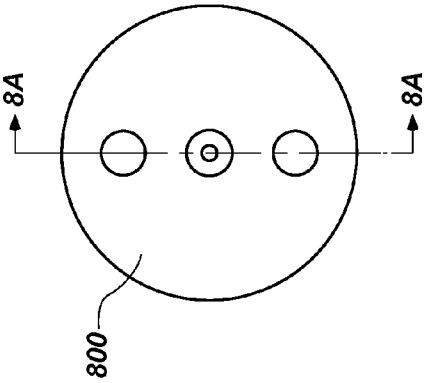
Figure 8B:
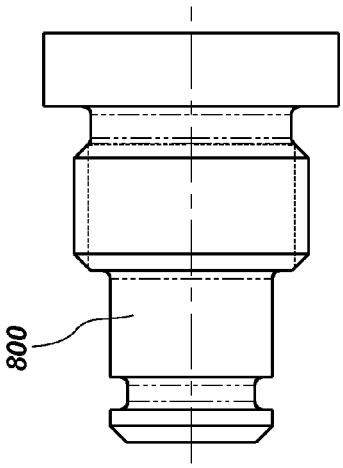
Figure 8A:
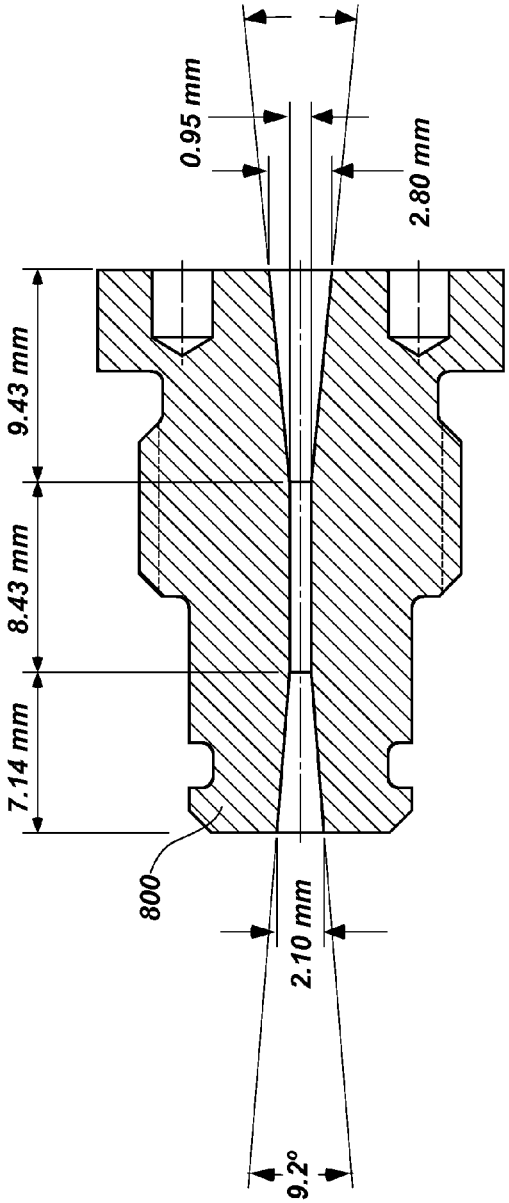

FIGS. 6A-6F are various views and section and section views of a particular embodiment of a nucleator block 320, according to the present invention. More particularly, FIG. 6A is a bottom view of the embodiment of a nucleator block 320. FIG. 6B is a right side view of the embodiment of a nucleator block 320. FIG. 6C is front view of the embodiment of a nucleator block 320, showing the section line taken in FIG. 6D. FIG. 6D is a cross-section view of the embodiment of a nucleator block 320 illustrating the nozzle channels 328 and The nucleator block 320 includes a circular mixing chamber receptacle 600, which feeds three nozzle channels 328, one each blocks 602, which in turn house nucleator nozzle receptacles 604. FIG. 6E is a section view of the embodiment of a nucleator block 320 as indicated in FIG. 6A. FIG. 6F is a perspective view of the embodiment of a nucleator block 320.

A balancing block 606 is used to offset the three blocks within the circular nucleator head 110. One novel feature of the embodiment of a nucleator block 320 shown in FIGS. 6A-6F is that the spaces in between the three blocks 602 housing the nucleator nozzle receptacles 604 in fluid communication with the nucleator nozzle channels 328 allows pressurized water to flow around the blocks 602 and nucleator nozzle receptacles 604, thereby eliminating freezing of the nucleator nozzles 112 (not shown). Thus, the nucleator block 320 is designed to have positive water circulation around nucleator nozzles 112 (not shown) to prevent the nozzles 112 (not shown) from freezing. Additionally, this design feature provides the capability to thaw frozen nucleator nozzles 112 (not shown) on start-up, through the positive water circulation.

FIGS. 7A-7D are section, side, front and perspective views, respectively of an embodiment of a nucleator nozzle 700, according to the present invention. Nozzle 700 is a convergent-divergent nozzle. In particular, a nucleator nozzle 700 having a converging conical inlet having a cone angle of about 5.6°, a core diameter of 1.4 mm, and a diverging conical exit orifice having a cone angle of about 12.7°, is illustrated.

FIGS. 8A-8D are section, side, front and perspective views, respectively of another embodiment of a nucleator nozzle 800, according to the present invention. In particular, a nucleator nozzle 800 having a converging conical inlet having a cone angle of about 9.2°, a core diameter of 0.95 mm, and a diverging conical exit orifice having a cone angle of about 11.2°, is illustrated.

The particular dimensions for nucleator nozzles 700 and 800 are not random and would not be obvious to one of skill in the art because of the number of factors and variable that can be manipulated to affect the quality of nucleation particles generated. The particular dimensions for nucleator nozzles 700 and 800 were optimized using a very specific methodology including a number of objectives as described below. The overall objective in optimizing the nucleator nozzle dimensions was to create a sufficient number of well-developed ice crystals to seed the water droplet plume of a dual-vector water nozzle producing up to 140 gpm (gallons per minute), while, maintaining good consistent snow quality.

Another objective was the ability to operate in a wide operational range for the available compressed air, e.g., 70 to 125 psi (pounds per square inch). To minimize operating costs, another objective was to use as little compressed air as possible, e.g., about 5 cfm (cubic feet per minute).

The dimensions relating to the ratio of throat (core diameter) to exit orifice were varied and simulated to determine the highest velocity through the throat section (core diameter), simultaneously with the greatest fluid temperature drop at the exit orifice.

In order to reduce the cost of the snow-making gun and reduce complexity of the system, it became an objective to use as few nucleator nozzles as possible to provide best coverage of the dual-vector water plume.

Because failure in the field is undesirable and because a robust snow-making system that can operate with a wide range of water sources and water quality is desirable, it was important to determine a minimum port size (core diameter) to avoid blockage in the field.

Another design feature of the nucleator nozzles 700 and 800 is that they are removable for cleaning in the unlikely event of blockage, for servicing and for allowing for different sizes of nucleator nozzles for any given application. Yet another design feature of the nucleator nozzles 700 and 800 is that they may be constructed from a material having high thermal conductivity (metal, e.g., aluminum, titanium, stainless steel, etc.) to ensure heat is transferred from surrounding water to prevent freezing and clogging of the nozzle channel. The following are additional general embodiments of the nucleators disclosed herein that may or may not include some or all of the features shown in the drawings.

An embodiment of a nucleator for generating ice crystals for seeding water droplets used in a snow-making system is disclosed. The embodiment of a nucleator may include a mixing chamber including a compressed air inlet for receiving compressed air directed along a mixing chamber axis. The embodiment of a mixing chamber may further include a water inlet for receiving water toward the mixing chamber axis and an exit orifice for delivering a mixture of compressed air and water. The embodiment of a nucleator may further include a nucleator block for receiving the mixture and configured for dividing and directing the mixture into a plurality of nozzle channels. According to this embodiment, each nozzle channel may lie in a plane perpendicular to, and separated from, one another by a select number of degrees. The embodiment of a nucleator may further include a plurality of nucleator nozzles, each of the plurality of nucleator nozzles configured with a nozzle inlet and a nozzle outlet, each of the plurality of nucleator nozzles further configured for receiving one of the plurality of nozzle channels at the nozzle inlet and continuously pressurizing the mixture along a convergent portion of the nozzle, thereby creating a pressurized mixture until the pressurized mixture reaches a core diameter of the nozzle, the pressurized mixture passing through the core diameter and directed through a divergent portion of the nozzle channel where the pressurized mixture depressurizes until exiting the nozzle outlet as tiny ice crystals.

According to one embodiment, the mixing chamber further include a water filter for filtering water prior to passing through the water inlet. According to a particular embodiment, the water filter may include a particle filter. According to yet another embodiment, the water filter may include a wire filter. According to still another embodiment, the water filter may include a cylindrical particle filter inside a cylindrical wire filter.

According to one more embodiment, the water inlet directs water into the mixing chamber along the mixing chamber axis. According to a particular embodiment, each of the plurality of nucleator nozzles may further include a conical convergent portion having a cone angle of about 5.6°. According to yet another embodiment, each ofthe plurality of nucleator nozzles may further include a core diameter of about 1.4 mm. According to still another embodiment, each of the plurality of nucleator nozzles may further include a conical divergent portion have a cone angle of about 12.7°.

According to yet one more embodiment, each of the plurality of nucleator nozzles further include a conical convergent portion having a cone angle of about 9.2°. According to a particular embodiment, each of the plurality of nucleator nozzles may further include a core diameter of about 0.95 mm. According to yet another embodiment, each of the plurality of nucleator nozzles may further include a conical divergent portion have a cone angle of about 11.2°. According to one particular embodiment, a snow-making gun may include a nucleator as described herein.

While the foregoing advantages of the present invention are manifested in the illustrated embodiments of the invention, a variety of changes can be made to the configuration, design and construction of the invention to achieve those advantages. Hence, reference herein to specific details of the structure and function of the present invention is by way of example only and not by way of limitation.

What is claimed is:

1. A nucleator for generating ice crystals for seeding water droplets used in a snow-making system, the nucleator comprising:

a hollow mixing chamber housing comprising an outer surface and an inner surface formed by a cylindrical mixing chamber passing axially along a mixing chamber axis from a proximate end to a distal end, the mixing chamber further comprising:

a compressed air inlet disposed at the proximate end for introducing compressed air into the mixing chamber along the mixing chamber axis;

a water inlet forming an opening between the outer surface and the inner surface of the mixing chamber housing, the inner surface forming an outer extremity of the mixing chamber within the housing, the water inlet disposed between the proximate end and the distal end of the mixing chamber, the water inlet configured for delivering water from the outer surface of the housing into the mixing chamber; and an exit orifice for delivering a mixture of compressed air and water;

a nucleator block for receiving the mixture and configured for dividing and directing the mixture into a plurality of radially directed nozzle channels; and a plurality of nucleator nozzles, each of the plurality of nucleator nozzles configured with a nozzle inlet and a nozzle outlet, each of the plurality of nucleator nozzles further configured for receiving one of the plurality of nozzle channels at the nozzle inlet and continuously pressurizing the mixture along a convergent portion of the nozzle, thereby creating a pressurized mixture until the pressurized mixture reaches a core diameter of the nozzle, the pressurized mixture passing through the core diameter and directed through a divergent portion of the nozzle channel where the pressurized mixture depressurizes until exiting the nozzle outlet as tiny ice crystals.

2. The nucleator according to claim 1, wherein the mixing chamber further comprises a water filter for filtering water prior to passing through the water inlet.

3. The nucleator according to claim 2, wherein the water filter comprises a particle filter.

4. The nucleator according to claim 2, wherein the water filter comprises a wire filter.

5. The nucleator according to claim 2, wherein the water filter comprises a cylindrical particle filter inside a cylindrical wire filter.

6. The nucleator according to claim 1, wherein the water inlet directs water into the mixing chamber along the mixing chamber axis.

7. The nucleator according to claim 1, wherein each of the plurality of nucleator nozzles further comprises a conical convergent portion having a cone angle of about 5.6°.

8. The nucleator according to claim 1, wherein each of the plurality of nucleator nozzles further comprises a core diameter of about 1.4 mm.

9. The nucleator according to claim 1, wherein each of the plurality of nucleator nozzles further comprises a conical divergent portion have a cone angle of about 12.7°.

10. The nucleator according to claim 1, wherein each of the plurality of nucleator nozzles further comprises a conical convergent portion having a cone angle of about 9.2°.

11. The nucleator according to claim 1, wherein each of the plurality of nucleator nozzles further comprises a core diameter of about 0.95 mm.

12. The nucleator according to claim 1, wherein each of the plurality of nucleator nozzles further comprises a conical divergent portion have a cone angle of about 11.2°.

13. A snowmaking system including a nucleator for generating ice crystals for seeding water droplets used to make artificial snow, the nucleator comprising:

a hollow mixing chamber housing comprising an outer surface and an inner surface formed by a cylindrical mixing chamber passing axially along a mixing chamber axis from a proximate end to a distal end, the mixing chamber further comprising:

a compressed air inlet disposed at the proximate end for introducing compressed air into the mixing chamber along the mixing chamber axis;

a water inlet forming an opening between the outer surface and the inner surface of the mixing chamber housing, the inner surface forming an outer extremity of the mixing chamber within the housing, the water inlet disposed between the proximate end and the distal end of the mixing chamber, the water inlet configured for delivering water from the outer surface of the housing into the mixing chamber; and an exit orifice for delivering a mixture of compressed air and water;

a nucleator block for receiving the mixture and configured for dividing and directing the mixture into a plurality of radially directed nozzle channels; and a plurality of nucleator nozzles, each of the plurality of nucleator nozzles configured with a nozzle inlet and a nozzle outlet, each of the plurality of nucleator nozzles further configured for receiving one of the plurality of nozzle channels at the nozzle inlet and continuously pressurizing the mixture along a convergent portion of the nozzle, thereby creating a pressurized mixture until the pressurized mixture reaches a core diameter of the nozzle, the pressurized mixture passing through the core diameter and directed through a divergent portion of the nozzle channel where the pressurized mixture depressurizes until exiting the nozzle outlet as tiny ice crystals.

* * * * *